US006205597B1

(12) United States Patent
Shimizu

(10) Patent No.: US 6,205,597 B1
(45) Date of Patent: Mar. 27, 2001

(54) AUTOMATIC HAIR WASHER

(75) Inventor: Hirohisa Shimizu, Osaka (JP)

(73) Assignee: Oohiro Works, Ltd., Osaka (JP)

( * ) Notice: Subject to any disclaimer, the term of this patent is extended or adjusted under 35 U.S.C. 154(b) by 0 days.

(21) Appl. No.: 09/378,336

(22) Filed: Aug. 20, 1999

(30) Foreign Application Priority Data

Nov. 10, 1998 (JP) ..... 10-319323

(51) Int. Cl.[7] ..... A45D 19/02
(52) U.S. Cl. ..... 4/518; 4/515; 4/519
(58) Field of Search ..... 4/515, 516, 517, 4/518, 519, 598, 602, 601, 618

(56) References Cited

U.S. PATENT DOCUMENTS 5,459,890 * 10/1995 Jarocki ..... 4/668
5,699,833 * 12/1997 Tsataros ..... 4/623

FOREIGN PATENT DOCUMENTS 52-11248 3/1977 (JP) .
WO 94/05179 * 3/1994 (JP) ..... 4/519
6-24606 4/1994 (JP) .
09028447 * 7/1997 (JP) .

* cited by examiner

*Primary Examiner*—Steven O. Douglas
*Assistant Examiner*—Khoa D. Huynh
(74) *Attorney, Agent, or Firm*—Burr & Brown

(57) ABSTRACT

A method of operating an automatic hair washer from initiation of a washing cycle to termination of the washing cycle including the step of pumping water from a hot water storing tank to a flow diversion control mechanism. At the initiation of a hair washing cycle, a portion of the water is transported through a delivery pipe to washing nozzles of the hair washer while the remainder of the water is simultaneously transported through a flow dividing pipe back to the hot water storing tank. After initiation of the hair washing cycle is completed, the flow diversion control mechanism is adjusted to direct all of the water to the delivery pipe.

2 Claims, 4 Drawing Sheets

AUTOMATIC HAIR WASHER

FIELD OF THE INVENTION

The present invention relates to an automatic hair washer which is found in a beauty salon, a barber's shop or the like and automatically washes a person's hair.

BACKGROUND OF THE INVENTION

FIG. 3 is a diagram illustrating a construction of a prior art automatic hair washer.

In the figure, reference numeral 1 designates a mixing tank for mixing water and hot water which is delivered from an external water supply and an external hot water supply via a curb stop, a strainer, and a check valve (which are not shown), in order to prepare wash water having a temperature suitable for hair washing. Numeral 2 designates a motor valve. Numeral 3 designates a hot water storing tank for storing the wash water supplied from the mixing tank 1 via the motor valve 2. Numeral 4 designates a thermistor provided at a lower position of the hot water storing tank 3 to measure a temperature of the wash water in the hot water storing tank 3. Numeral 5 designates a float switch for detecting an amount of the wash water in the hot water storing tank 3. Numeral 6 designates a hot water supplying pump for pumping out the wash water from the hot water storing tank 3. Numeral 7 designates a valve for hand shower. Numeral 8 designates a drawable hand shower used for washing off hairs, shampoo agent, or rinse agent which are attached to a cistern, or in finishing hair washing. Character $A_1$ designates a hot water supply pipe, one end of which is connected to the hot water supplying pump 6, to lead the wash water pumped out by the hot water supplying pump 6. Numeral 9 designates a draining electromagnetic valve provided in midway of the hot water supply pipe $A_1$ to drain unnecessary wash water. Numerals 10*a* to 10*k* designate hot water supplying electromagnetic valves. Characters $SV_1$ to $SV_{11}$ designate shower heads, each being connected to an end of the branched hot water supply pipe $A_1$ to spout the wash water. Numeral 11 designates a shampoo tank for storing shampoo agent. Numeral 12 designates a rinse tank for storing rinse agent. Numeral 13 designates a shampoo supplying pump for pumping out the shampoo agent from the shampoo tank 11. Numeral 14 designates a rinse supplying pump for pumping out the rinse agent from the rinse tank 12. Numerals 15 and 16 designate check valves. Numeral 17*a* to 17*f* designate nozzle heads, each being connected to an end of the branched hot water supply pipe $A_1$ to spout the wash water mixed with the shampoo agent or the rinse agent which is pumped out from the shampoo tank 11 or the rinse tank 12.

FIG. 4 is a longitudinal sectional view of a cistern in the prior art automatic hair washer.

In the figure, the same reference numerals and characters as those in FIG. 3 designate the same or corresponding parts. Character B designates a cistern. A person whose hair is to be washed lies on his back and inserts his head into this cistern B to have his hair washed. As shown in the figure, a plurality of washing nozzles are provided inside the cistern B, and the wash water is spouted from these washing nozzles and reaches the head of the person under hair washing.

Hereinafter, operation of the prior art automatic hair washer will be described.

First, in an initial operation, hot water and cold water is provide to the mixing tank 1 from an external water supply and a external hot water supply via a curb stop, a strainer, and a check valve. The hot water and the cold water is mixed in the mixing tank 1 to become warm water having a temperature suitable for hair washing, and is supplied to the hot water storing tank 3 via the motor valve 2. Then the wash water stored in the hot water storing tank 3 is delivered by the hot water supplying pump 6 and spouted from the shower heads $SV_1$ to $SV_{11}$ through the hot water supply pipe $A_1$ via the hot water supplying electromagnetic valves 10*a* to 10*k*. After the wash water is spouted from the shower heads $SV_1$ to $SV_{11}$ during a predetermined period, spouting of the wash water is stopped and the following process, is started. Shampoo agent pumped by the shampoo supplying pump 13 is spouted from the nozzle heads 17*a* to 17*f* together with the wash water. When the shampooing process ends, the rinsing process and the process for washing with clean water follow, and then the washing process ends.

In using the above-described prior art automatic hair washer, when the hair washer is used after a significant lapse of time from the previous use, the hot water in the piping of waterway or in the washing nozzles is cooled. Therefore, the head of the person under hair washing is exposed to the cold water pouring first from the washing nozzles, whereby he feels discomfort.

In addition, hairs or bubbles may remain in the cistern at the end of hair washing, whereby the next person under hair washing feels displeasure by seeing the same.

SUMMARY OF THE INVENTION

To solve the above problems, it is an object of the present invention to provide an automatic hair washer which allows cold water to flow so as not to splash over the head of the person under hair washing and also make good use of the cold water.

Other objects and advantages of the present invention will become apparent from the detailed description. The specific embodiments described are provided only for illustration since various additions and modifications within the spirit and scope of the invention will be apparent to those of skill in the art from the detailed description.

According to a first aspect of the present invention, an automatic hair washer having washing nozzles for spouting wash water to hair comprises a hot water storing tank for storing wash water, a pump for pumping out the wash water from the hot water storing tank to deliver under a predetermined hydraulic pressure, a delivery pipe for supplying the wash water delivered by the pump to the washing nozzles, a flow dividing pipe laid to feed back part of the wash water which is delivered by the pump, to the hot water storing tank, from midway of the course from the pump in the delivery pipe to the washing nozzles, and a flow diversion control means for controlling such that the hydraulic pressure of the wash water supplied to the washing nozzles is decreased and the wash water pouring from the washing nozzles does not spout, by feeding back part of the wash water delivered from the pump to the hot water storing tank via the dividing pipe during a predetermined period from the beginning of water discharging operation from the washing nozzles. Therefore, at the beginning of the operation, the wash water flowing from the washing nozzles is made not to spout, whereby the cold water remaining in the piping is prevented from splashing over the head of the person under hair washing, resulting in more comfortable services of hair washing being provided to the person.

In addition, according to the present invention, bubbles or hairs which are attached to the cistern are washed off with the wash water in the piping without extra water being used for washing the cistern, thereby saving water.

Further, part of the wash water which is pumped out from the hot water storing tank is fed back to the hot water storing tank via a hot water circulating pipe, thereby making the most use of the wash water.

DETAILED DESCRIPTION OF THE PREFERRED EMBODIMENTS

Embodiment 1

Figure 1:
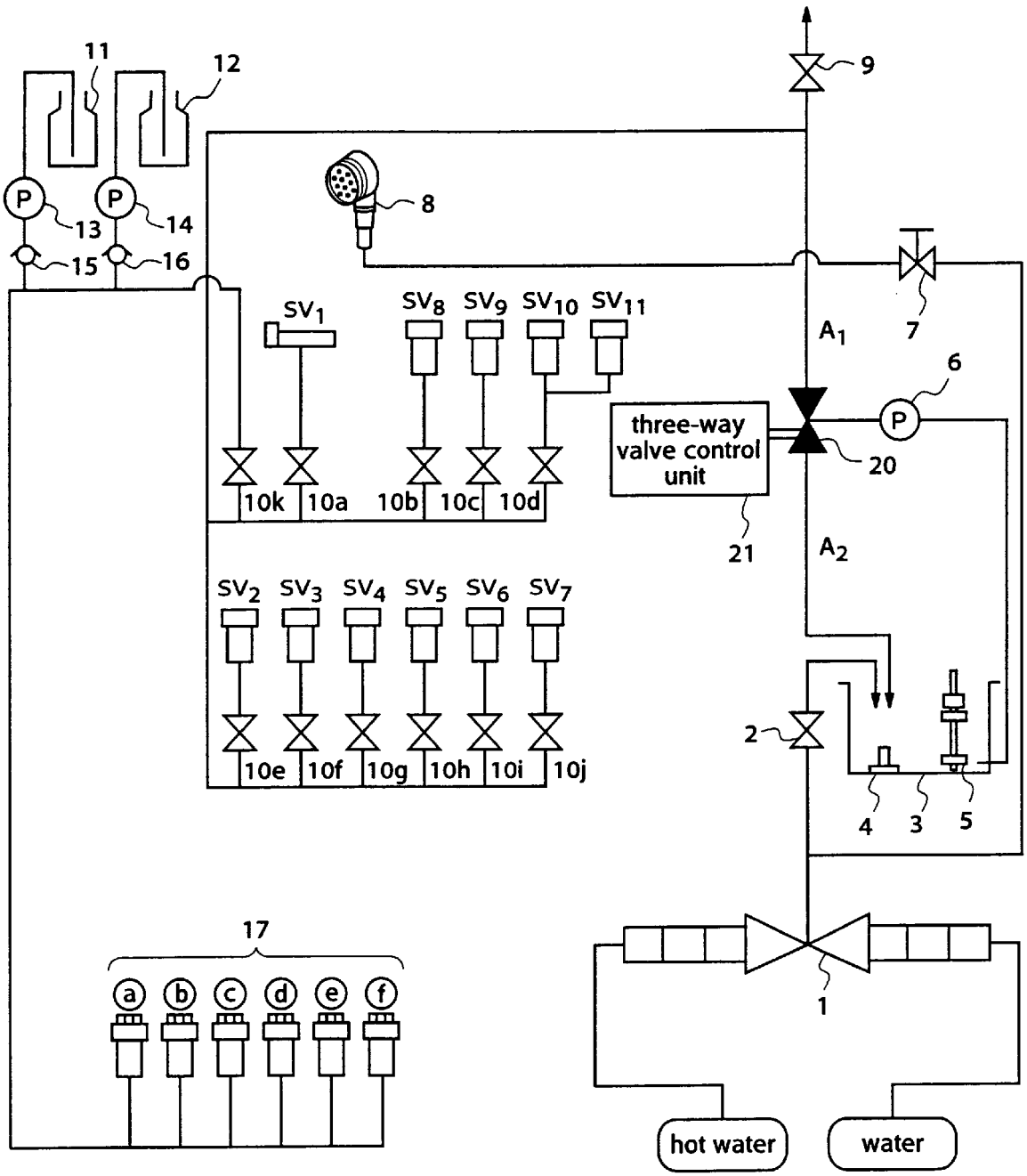
FIG. 1 is a diagram illustrating a construction of an automatic hair washer according to a first embodiment of the present invention.

FIG. 1 is a diagram illustrating a construction of an automatic hair washer according to a first embodiment of the present invention.

Figure 3:
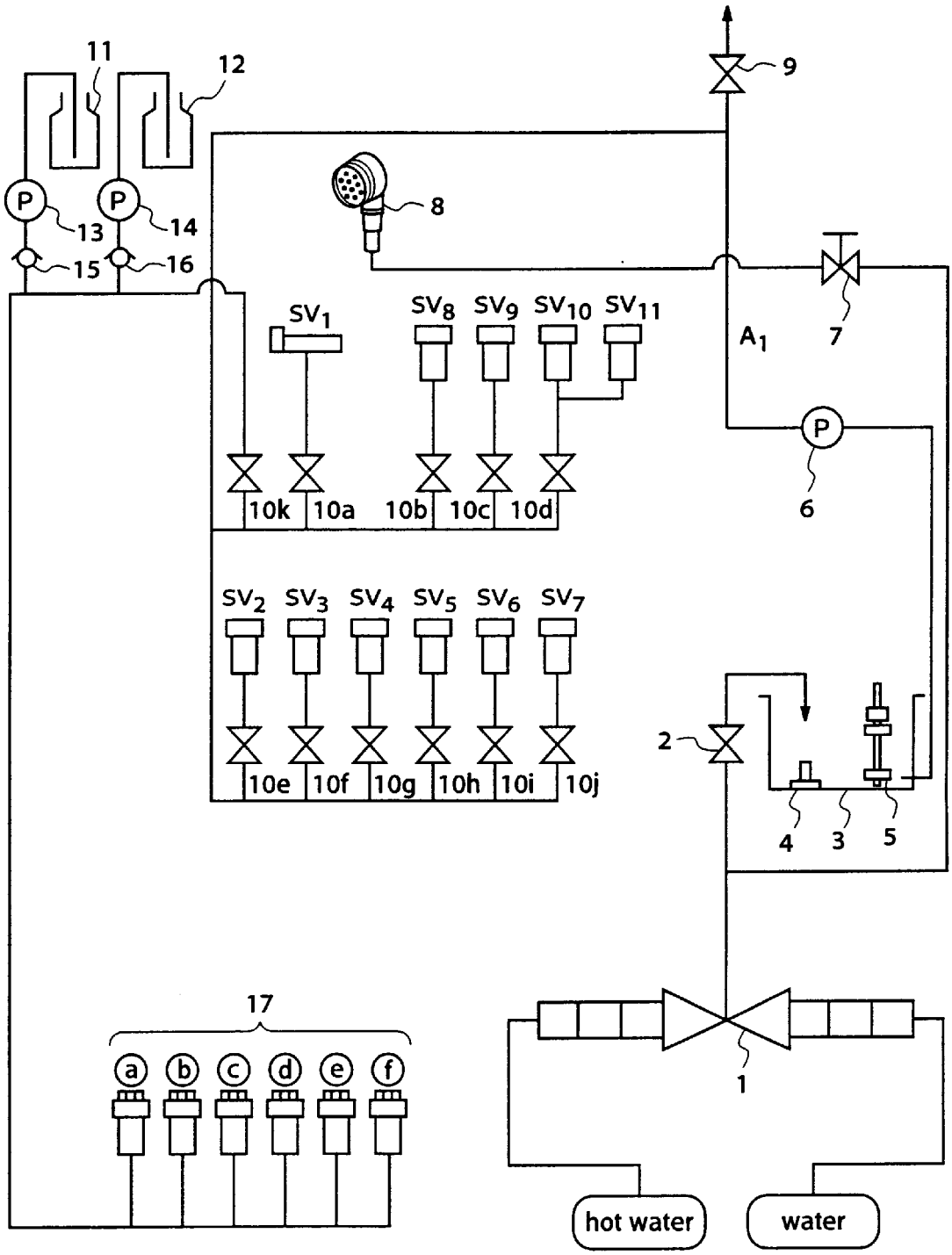
FIG. 3 is a diagram illustrating a construction of a prior art automatic hair washer.
Figure 4:
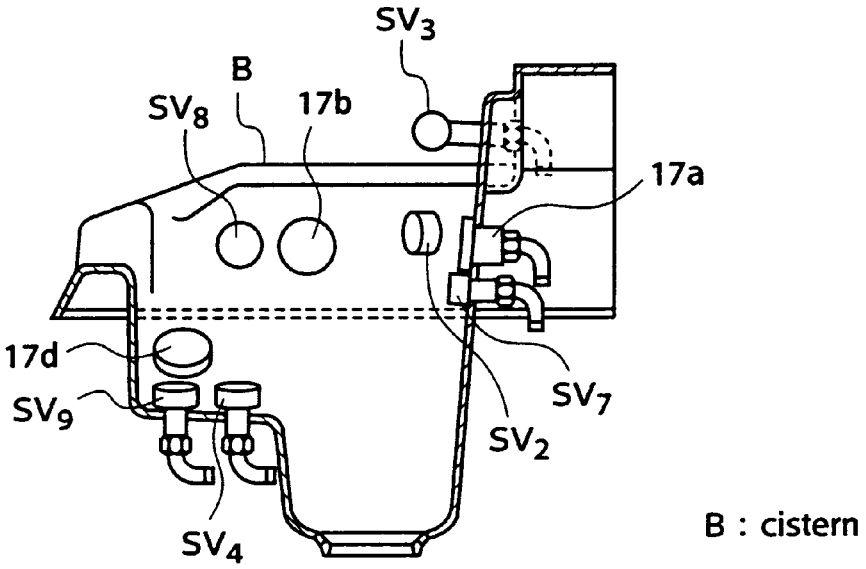
FIG. 4 is a longitudinal sectional view illustrating a cistern in the prior art automatic hair washer.

In the figure, the same reference numerals and characters as those in FIG. 3 designate the same or corresponding parts. Reference numeral 20 designates a three-way valve provided in midway of the hot water supply pipe $A_1$. Character $A_2$ designates a hot water circulating pipe, one end of which is connected to the three-way valve 20 and the other end is connected to the hot water storing tank 3, for leading part of the wash water which is pumped out by the hot water supplying pump 6, to the hot water storing tank 3. Numeral 21 designates a three-way valve control unit for controlling the amounts of water delivered to the hot water supply pipe $A_1$ and the hot water circulating pipe $A_2$ by controlling the three-way valve 20.

Hereinafter, operation of the automatic hair washer according to the first embodiment will be described.

First, in an initial operation, hot water and cold water is provided to the mixing tank 1 from an external water supply and an external hot water supply via a curb stop, a strainer, and a check valve. The hot water and the cold water is mixed in the mixing tank 1 to become warm water having a temperature suitable for hair washing, and supplied to the hot water storing tank 3 via the motor valve 2. Then the wash water stored in the hot water storing tank 3 is delivered by the hot water supplying pump 6, supplied to the three-way valve 20, and flow-divided to the hot water supply pipe $A_1$ and the hot water circulating pipe $A_2$ by the three-way valve 20. In this case, output from the hot water supplying pump 6 is uniform, i.e., the hydraulic pressure of the wash water supplied from the hot water supplying pump 6 to the three-way valve 20 is uniform. However, the hydraulic pressure of the wash water supplied to the washing nozzles can be varied by controlling the three-way valve 20 by the three-way valve control unit 21 and feeding back part of the wash water which is delivered from the hot water supplying pump 6 to the hot water storing tank 3 via the hot water circulating pipe $A_2$.

Figure 2:
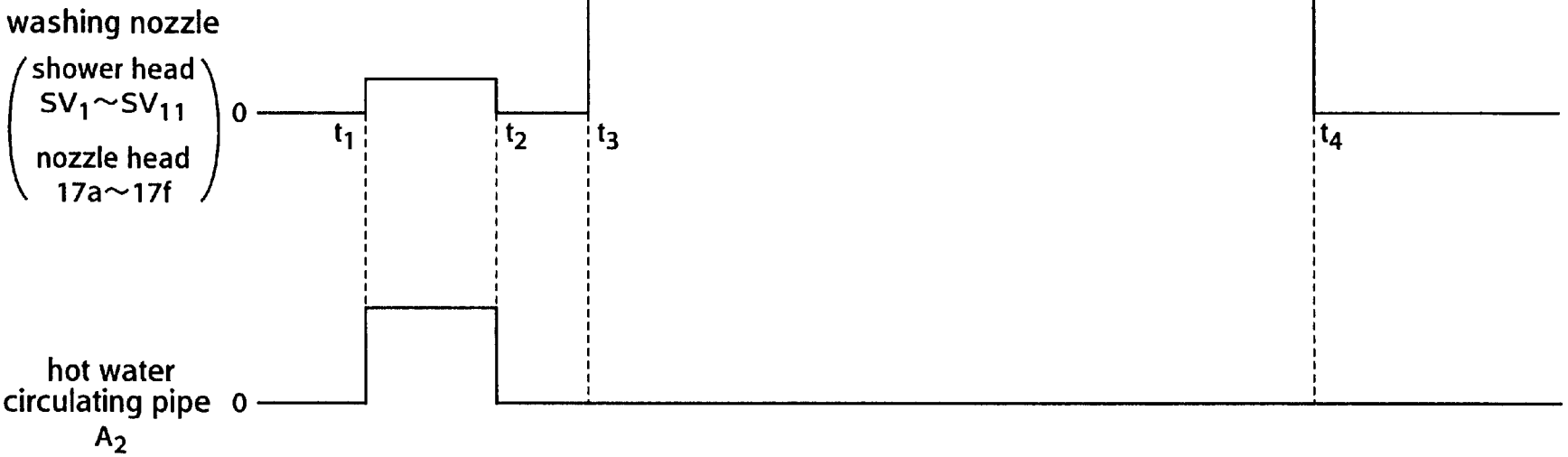
FIG. 2 is a timing chart showing an amount of wash water flowing from washing nozzles through a hot water supply pipe and an amount of wash water flowing to a hot water storing tank through a hot water circulating pipe, in the entire washing process according to the automatic hair washer of the first embodiment.

FIG. 2 is a timing chart showing an amount of wash water flowing from the washing nozzles through the hot water supply pipe $A_1$ and an amount of wash water flowing to the hot water storing tank 3 through the hot water circulating pipe $A_2$, in the entire process of hair washing, i.e., the initial washing, the shampooing and rinsing process, and the process for washing with clean water.

In the figure, washing of the cistern B is started at timing $t_1$, washing of the cistern B ends at timing $t_2$l washing hair of a person is started at timing $t_3$, and washing hair of the person ends at timing $t_4$.

While washing the cistern B, the ratio of the amount of water supplied to the washing nozzles via the hot water supply pipe $A_1$ to the amount of water supplied to the hot water storing tank 3 via the hot water circulating pipe $A_2$ is, for example, 1 to 9. That is, the hydraulic pressure of the wash water flowing through the hot water supply pipe $A_1$ is one-tenth the hydraulic pressure of the wash water as compared to when the wash water is supplied only to the washing nozzles. Therefore, the cold water remaining in piping or the like is not spouted forcibly from the shower heads $SV_1$ to $SV_{11}$ and the nozzle heads 17*a* to 17*f* but drained gently. Thus if hairs of the preceding person, or bubbles of shampoo agent or the like are attached to the cistern B, they are removed by the cold water. In addition, the amount of the cold water in the pipeline which is fed back to the hot water storing tank 3 through the hot water circulating pipe $A_2$ is very small. Therefore, the wash water in the hot water storing tank 3 is not cooled abruptly by the cold water. After the cold water flows from the shower heads $SV_1$ to $SV_{11}$ and nozzles heads 17*a* to 17*f* during a predetermined period, the operation of the automatic hair washer stops.

Next, while the automatic hair washer is stopped, the person under hair washing lies on his back with his head inserted into the cistern B. Then the automatic hair washer is restarted and warm wash water is spouted forcibly to the head of the person from the shower heads $SV_1$ to $SV_{11}$. In this case, a valve of the three-way valve 20 on the side of the hot water circulating pipe $A_2$ is closed by the three-way valve control unit 21. Therefore, the wash water is not supplied to the hot water circulating pipe $A_2$ and flows only through the hot water supply pipe $A_1$.

After the wash water is spouted from the shower heads $SV_1$ to $SV_{11}$during a predetermined period, spouting of the wash water is stopped and the following shampooing process is started. The shampoo agent pumped by the shampoo supplying pump 13 is spouted from the nozzle heads 17*a* to 17*f* together with the wash water. When the shampooing process ends, the next rinsing process and the process for washing with clean water follow, and then the washing process ending.

In the first embodiment, the operation of the automatic hair washer is temporarily stopped after washing the cistern B, and a person under hair washing inserts his head into the cistern B while the hair washer stops, then the hair washer is started again. However, even if the operation is started with the head of the person inserted into the cistern B, the cold water flows gently from the washing nozzles, whereby the cold water does not splash onto the head of the person.

In addition, the amount of the wash water flowing from the washing nozzles may be varied in accordance with the processes such as the shampooing and rinsing processes and the process for washing with clean water, by controlling the three-way valve 20 by the three-way valve control unit 21.

Further, in the first embodiment, while the hydraulic pressure of the wash water flowing toward the washing nozzles is controlled by the three-way valve 20, the hydraulic pressure of the wash water flowing toward the washing nozzles may be controlled by providing a flow dividing passage for branching the hot water supply pipe $A_1$ and feeding back the wash water to the hot water storing tank 3, providing a valve gear in midway of the flow dividing passage, and controlling the valve gear.

As described above, according to the first embodiment of the present invention, the three-way valve 20 is provided in midway of the course from the hot and cold water supplying pump 6 to the washing nozzles, and the three-way valve 20 is controlled by the three-way valve control unit 21. Thereby, part of the wash water pumped out from the hot water storing tank 3 is flow-divided to the hot water circulating pipe $A_2$ via three-way valve 20, during the predetermined period from beginning of the washing process, thereby decreasing the amount of the water supplied to the washing nozzles. Therefore, at the beginning of washing process, the wash water flowing out from the shower heads $SV_1$ to $SV_{11}$ and nozzle heads 17*a* to 17*f* is made not to spout, thereby preventing the cold water from splashing over the head of the person under hair washing and not making the person feel uncomfortable. In addition, the wash water flowing out from the shower heads $SV_1$ to $SV_{11}$ and the nozzle heads 17*a* to 17*f* at the beginning of washing process is made not to spout, thereby enabling the washing off of bubbles or hairs which are attached to the cistern B. By making use of the cold water in the piping, there is no need to use extra water for washing the cistern B, thereby saving water. Further, part of the wash water pumped out from the hot water storing tank 3 is fed back to the hot water storing tank 3 through the hot water circulating pipe $A_2$ via the three-way valve 20, thereby making the most use of the wash water.

What is claimed is:

1. A method of operating an automatic hair washer from initiation of a washing cycle to termination of the washing cycle, said automatic hair washer including a basin having nozzles, said nozzles arranged around said basin, a hot water storing tank and a pump for pumping wash water from said hot water storing tank to said nozzles, comprising the steps of:

pumping water from the hot water storing tank to a flow diversion control mechanism;

at the initiation of a hair washing cycle, transporting a portion of the water through a delivery pipe to the washing nozzles of the hair washer;

simultaneously transporting the remainder of the water through a flow dividing pipe back to the hot water storing tank; and after initiation of the hair washing cycle is completed, adjusting the flow diversion control mechanism to direct all of the water to the delivery pipe.

2. The method of operating an automatic hair washer as recited in claim 1, wherein the flow diversion control mechanism is adjusted to gradually redirect all of the water to the delivery pipe after initiation of the hair washing cycle is completed.

* * * * *